US006577236B2

(12) United States Patent
Harman

(10) Patent No.: US 6,577,236 B2
(45) Date of Patent: Jun. 10, 2003

(54) FM CW CABLE GUIDED INTRUSION DETECTION RADAR

(76) Inventor: Robert Keith Harman, 1222 W. Baseline Rd., #104, Tempe, AZ (US) 85283

( * ) Notice: Subject to any disclaimer, the term of this patent is extended or adjusted under 35 U.S.C. 154(b) by 0 days.

(21) Appl. No.: 09/945,061

(22) Filed: Aug. 31, 2001

(65) Prior Publication Data

US 2002/0041232 A1 Apr. 11, 2002

Related U.S. Application Data

(60) Provisional application No. 60/229,815, filed on Sep. 5, 2000.

(51) Int. Cl.[7] ..... G08B 13/18

(52) U.S. Cl. ..... 340/552; 340/564; 340/565; 333/237

(58) Field of Search ..... 340/552, 564, 340/565, 566, 567; 333/237

(56) References Cited

U.S. PATENT DOCUMENTS 4,091,367 A * 5/1978 Harman ..... 340/258
4,300,338 A * 11/1981 Harman et al. ..... 57/3
4,562,428 A * 12/1985 Harman et al. ..... 340/552
4,599,121 A * 7/1986 Edwards et al. ..... 156/48
4,760,362 A 7/1988 Maki ..... 333/237
4,879,544 A * 11/1989 Maki et al. ..... 340/552
4,987,394 A * 1/1991 Harman et al. ..... 333/237
4,994,789 A * 2/1991 Harman ..... 340/552
5,049,858 A * 9/1991 Price ..... 340/552
5,247,270 A * 9/1993 Harman et al. ..... 333/237
5,448,222 A * 9/1995 Harman ..... 340/566
5,510,766 A * 4/1996 Harman et al. ..... 340/552
5,936,203 A * 8/1999 Ryman ..... 174/109
5,939,982 A * 8/1999 Gagnon et al. ..... 340/539
6,252,507 B1 * 6/2001 Gagnon ..... 340/552
6,288,640 B1 * 9/2001 Gagnon ..... 340/539

OTHER PUBLICATIONS

"Propagation Along a Coaxial Cable with a Helical Shield" by D.A. Hill and J.R. Wait Feb. 1980.

* cited by examiner

*Primary Examiner*—Benjamin C. Lee
*Assistant Examiner*—Phung T Nguyen
(74) *Attorney, Agent, or Firm*—Joseph H. Roediger; Gregory J. Nelson

(57) ABSTRACT

A FM CW cable guided radar for the detection and location of outdoor perimeter intruders. Helically wound outer conductors on coaxial transmit and receive transmission lines provide a slow wave structure to support the propagation of external electromagnetic fields. The two leaky coaxial lines are enclosed in an extruded plastic jacket with the outer conductors in continuous electrical contact along the length of the cable. A chirp frequency modulation provides a continuous target response having a baseband frequency that is proportional to the distance along the length of the cable. After location determination, the amplitude of the response is compared to a location specific threshold to determine if an intruder is present.

22 Claims, 3 Drawing Sheets

FM CW CABLE GUIDED INTRUSION DETECTION RADAR

CROSS REFERENCE TO RELATED APPLICATION

The present application is based on provisional patent application Ser. No. 60/229,815 filed Sep. 5, 2000.

BACKGROUND OF THE INVENTION

This invention relates to cable guided intrusion detection systems and, in particular, to a system having an FM CW sensor using helically wound coaxial transmission lines to locate the intruder and using a location dependent threshold to declare the presence of an intruder.

DESCRIPTION OF RELATED PRIOR ART

Cable guided radar has been used to detect intruders since the early 1970's. One of the earliest leaky coaxial cable intrusion sensors is the subject of U.S. Pat. No. 4,091,367. In this system, parallel leaky coaxial cables are buried around the perimeter of the site being protected. A pulse of RF energy is transmitted along one cable to setup an external electromagnetic field that propagates along the length of the cable. The second leaky coaxial cable receives energy reflected from the intruder thereby returning a portion of the transmitted pulse back to the receiver. The time delay between the onset of the transmit pulse and the receipt of the reflected pulse is used to determine the location of the intruder along the length of the cable pair. In order to compensate for attenuation, "graded cables" in which the aperture size increases with distance are used. While many different means of grading cables have been developed, all such techniques increase the cost of the cable.

In the system disclosed in U.S. Pat. No. 4,091,367, a 400-nanosecond pulse with a carrier frequency of 60 MHz is used. An analog to digital converter is used to find 84 In-phase and 84 Quadrature samples of the received signal from a 5280-foot long cable. This provides a digital sample for 62-foot cells or segments along the length of the cable pair. Based on a calibration walk, a separate threshold is applied to each cell. One factor limiting the performance of the system described in U.S. Pat. No. 4,091,367 is the relatively low duty cycle. The 400 nanoseconds pulse width and a 30 kHz repetition rate limits the duty cycle to about 1.2%. The FM CW approach utilized in the present invention allows for up to a 100% duty cycle and hence a significant improvement in Signal to Noise Ratio (SNR).

A second factor limiting the performance of the system described in U.S. Pat. No. 4,091,367 is the substantial variation in sensitivity within each 62-foot cell. Typical soil conditions and installation practice created up to 15-dB variation in the response within each 62 foot cell. One factor contributing to this variation is multipath field cancellation due to its relatively narrow bandwidth to carrier frequency ratio of 4.1%. A second factor is the multiple reflections on the two-wire line formed by the outer conductors of the separate transmit and receive cables. With only one threshold per cell, a threshold set to ensure 95% Probability of Detection (Pd) could detect small animals as nuisance alarms at the more sensitive locations within the cell. In the present invention, the location of the intrusion is determined within 1 to 2 meters prior to applying a threshold thereby overcoming this problem. In addition, the bandwidth of the FM CW chirp transmission and the elimination of the two-wire line mode obtained with this invention substantially reduces the sensitivity variation along the length of the transducer cable.

The high-speed logic associated with pulse cable guided radar described in U.S. Pat. No. 4,091,367 and the large diameter leaky coaxial cable that it uses result in a relatively costly perimeter security product. This lead to the development of CW sensors with distributed processing such as described in U.S. Pat. No. 4,562,428. This type of system reduces the cost of leaky cable perimeter security, however, it introduces several problems. Because there is no ability to locate the intruder along the length of the cable in a CW system, one threshold is applied to the entire length of cable. Typically, these cables are 100 to 150 meters long. To make this system operable, the cable has to be graded. A graded cable is one in which the apertures are increased with distance along the length of the cable to compensate for attenuation. Even with a perfectly graded cable there is increased variation in sensitivity along the cable length when compared with the 62-foot cells of the pulsed cable guided radar of U.S. Pat. No. 4,091,367. This is a source of nuisance alarms.

Leaky coaxial cables such as that described in U.S. Pat. Nos. 4,300,388, 4,599,121 and 4,660,007 or some of those illustrated in U.S. Pat. No. 4,091,367 have diamond shaped apertures that are comparable in size to the cable diameter and support both magnetic and electric field coupling. The electric field coupling (sometimes referred to as capacitive coupling) is affected by the dielectric constant of the medium surrounding the cable. This can lead to significant changes in the strength of the external electromagnetic fields when the cable is buried in wet soil as it freezes. Secondly, if mounted above ground these cables support external modes of propagation which cause large periodic variations in sensitivity. This mode cancellation problem has limited these cables to buried applications.

There are a number of cables with continuously slotted outer conductors such as that described in U.S. Pat. No. 5,834,688 wherein the continuous slot can be used for grading. The cable described therein has a second outer conductor made from conductive plastic with the conductivity of the plastic jacket selected so as to limit electric field coupling while accentuating magnetic coupling. This cable is made costly to produce by the grading of the foil outer conductor and the use of conductive plastic second outer conductor. The conductive plastic is expensive, difficult to work with and requires a separate extrusion process.

When installed with the cables buried in the ground, the cost of installation of these two cable systems is very significant. The introduction of the Siamese or twin leaky coaxial cable described in U.S. Pat. No. 5,247,270 was the first attempt at producing a single cable system so as to essentially reduce the installation cost by a factor of two. This cable has two metallic outer conductors. The first outer conductor is a continuously slotted foil designed to provide cable grading and the second is a helically wrapped steel wire to support magnetic field coupling while minimizing electric field coupling from inside to outside of the cable. This patent reference describes the virtues of magnetic coupling as opposed to electric field coupling. The continuous taper of the first foil outer conductor and the high pitch steel winding of the second outer conductor make this cable expensive to manufacture.

The present invention utilizes FM CW signal processing to locate intruders along the length of the cable while eliminating the need to grade the cable thereby making the single helically wrapped outer conductor cable described herein considerably lower in cost than existing leaky cable structures. The complete circumferential coverage of the outer conductor of the new cable ensures magnetic field coupling without electric field coupling. It also provides a slow wave structure to facilitate the use of the cable above ground as well as in buried applications.

U.S. Pat. No. 5,446,446 describes an acoustical cable perimeter security sensor employing a coded pulse transmission. While this sensor detects motion of the cable and does not have external electromagnetic fields, it does locate the intruder using an ultra-wideband transmission. This ability to locate has proven to be very beneficial in allowing the installer to create detection zones in software. The flexibility of this feature is very important when using the sensor with CCTV assessment. This "Free Format Zoning" benefit is attained using the FM CW cable guided radar system which is the subject of the present invention. Furthermore, the ability of the subject invention to locate the intruder before applying the threshold has proven to be very effective in overcoming variations in sensitivity along the length of the cable. This "Sensitivity Leveling" benefit is provided in the subject FM CW cable guided radar.

In summary, the FM CW cable guided radar described herein provides a cost effective perimeter field disturbance sensor with a high duty cycle along with all of the benefits associated with the ability to locate an intruder along the length of the cable transducer and reduces the likelihood of indicating a false alarm condition by using location specific thresholds.

BRIEF SUMMARY OF THE INVENTION

The present invention uses a chirp FM CW transmission on one leaky coaxial transmission line to create an external electromagnetic field, which is monitored, by a second leaky coaxial transmission line in a Siamese or twin cable construction to detect and locate intruders. By time sharing the FM CW signal processing circuitry between two cables, a 50% duty cycle is achieved which has the beneficial Signal to Noise characteristics of a CW sensor as well as the ability to locate the intruder along the length of the cable.

The ultra wide bandwidth of a HF band chirp transmission minimizes the variation in sensitivity along the length of the cable by averaging over the sweep. The present system utilizes a cable wherein the outer conductors of the transmit and receive coaxial lines are in continuous electrical contact along the length of the cable thereby eliminating any two-wire line mode between the outer conductors of the two coaxial lines. The helical outer conductors on the two coaxial lines are counter wound. The helical nature of the outer conductors is designed to support a surface wave and maximize magnetic field coupling while minimizing capacitive coupling. Magnetic coupling minimizes the environmental effects and the surface wave can be supported with the cables either buried or above ground.

Quadrature detection is used to generate complex inputs to a Fast Fourier Transform (FFT). Both the frequency and phase output of the FFT are used to accurately locate the intruder along the length of the cable. This location information is used to apply a location specific threshold to the response amplitude in order to compensate for the variations in sensitivity along the length of the cable. Each processor operates with two lengths of Siamese cable extending in opposite direction from the processor. An upward sweeping chirp is applied to one cable and a downward sweeping chirp is applied to the other so as to minimize interference between multiple sensors.

This system provides a higher probability of detection with a lower false alarm rate at a significantly lower cost than the systems described in the prior art. Further features and advantages of the invention will become more readily apparent from the following description of a preferred embodiment when taken in conjunction with the accompanying drawings.

PREFERRED EMBODIMENT OF THE INVENTION

In the present invention, a FM CW cable guided radar system serves to detect and locate intruders that move in proximity to a cable installed around the perimeter of a site. The cable can go around corners and follow the contours of the site terrain. The cable can be buried to create a covert sensor or used laying on the surface of the ground to facilitate rapid deployment for the detection of intruders. The location information derived from the FFT can be used to point and focus a CCTV camera on the unsuspecting intruder to assess the nature of the intruder.

Figure 1:
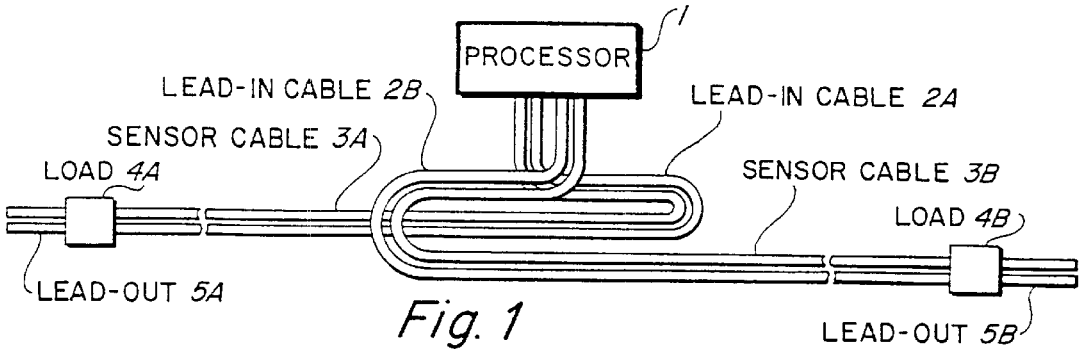
FIG. 1 is a block diagram of a preferred embodiment of the FM CW cable guided radar which is the subject of the present invention system monitoring two lengths of sensor cable.

As shown in the embodiment of FIG. 1, Processor 1 has four ports that connect to two cable sensors. The first 10 meters of the cable, 2A and 2B, are used to connect the processor to the detection portion of the cable such that the processor can be positioned outside of the detection zone. The lead-in cable is the same Siamese leaky cable as used for detection but the processing is designed to eliminate the detection of people or things moving in proximity to the processor. Normally the processor is installed in an above ground enclosure on the protected side of the perimeter boundary.

The two cables are typically installed with a 10 meter overlap between cables A and B. The external electromagnetic fields generated by the transmitted signal builds over the first 10 to 15 meters of cable. The overlap zone ensures that the field has reached a sufficient level to facilitate the detection of intruders at the middle of the startup zone thereby ensuring continuous detection of intruders from cable A to B.

There are two leaky coaxial transmission lines in each of Siamese leaky cables 3A and 3B. One transmission line is connected to the transmitter port of the Processor 1 while the other connects to the receiver port of the processor. The FM CW transmission along the cables 3A and 3B creates an electromagnetic field that propagates as a surface wave along the length of the cables. When the transmitted signal propagating inside the coaxial lines reaches the ends of the cables they are terminated in matched Loads 4A and 4B. Termination resistors that match the characteristic impedance of the coaxial lines ensures that the energy is absorbed and not reflected back along the line to create confusion in the detection process. The surface waves propagating on the outside of the cables are terminated in Lead-out lines 5A and 5B. The purpose of the lead-out line is to provide a structure to guide the surface wave away from the leaky cables and be attenuated naturally in the medium surrounding the lead-out cables. This prevents unwanted reflections from the end of the leaky cables.

The lead-in cables 2A and 2B also connect the second leaky coaxial transmission lines in sensor cables 3A and 3B to the receiver ports of the Processor 1. The external surface wave propagating along the length of sensor cables 3A and 3B couples into the receive coaxial transmission lines. Some of this coupled energy continues to propagate towards the ends of the cables to be terminated in the loads 4A and 4B. As with the transmit lines, the matched loads prevent unwanted reflections on the receive cables. Of most interest however is the energy which propagates back towards the processor. It is this contra-directionally-coupled signal that contains the target information. As an intruder moves within the detection zone, the surface wave is disturbed causing the signal at the receiver port of the processor to change. As in Moving Target Indicator (MTI) radar, it is this change in the received signal that is detected. The propagation delay for the transmit signal to reach the target and return to the processor creates a baseband frequency that is directly proportional to the distance along the length of the cable.

In an installation of the embodiment shown, sensor cables 3A and 3B are 205 meters long. With this length of leaky cable and the 10 meters of lead-in cable one is able to create a detection zone which is 200 meters long. As mentioned, sensor cables 3A and 3B each comprise two leaky coaxial transmission lines.

Loads 4A and 4B each comprise two 47-ohm resistors that are attached to each of the two leaky coaxial transmission lines that comprise leaky cables 3A and 3B.

Lead-outs 5A and 5B are 5 meters long and are made from the same Siamese cable. The outer conductor of the lead-out cables is connected to the outer conductors of the sensor cable in the load enclosure. The inner conductors are not connected. The braid on the lead-out provides a means of effectively terminating the surface waves traveling on the outside of the sensor cable.

Figure 2:
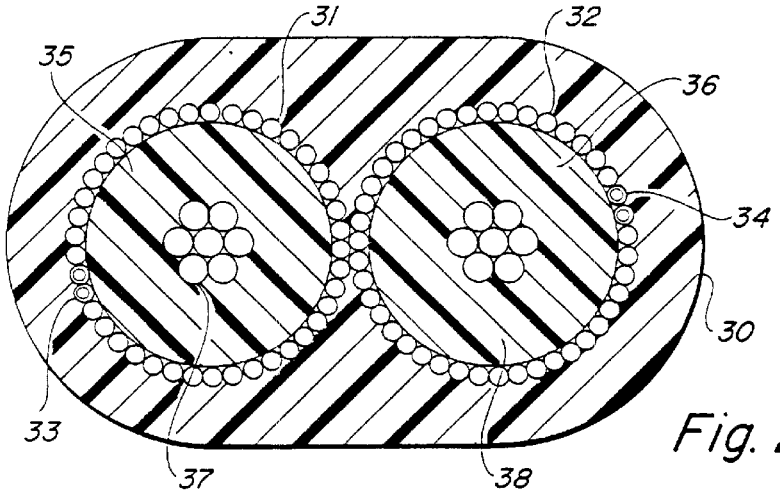
FIG. 2 is a view cross section of the Siamese leaky coaxial cable utilized in the system of FIG. 1 that shows the structure thereof.

The same Siamese leaky cable construction illustrated in FIG. 2 is used for the lead-in cables 2A and 2B, the active sensor cables 3A and 3B and the lead-out cables 4A and 4B. One leaky coaxial transmission line is formed by the helically wound outer conductors 31 and 33, the dielectric material 35 and stranded center conductor 37. The second leaky coaxial transmission line is formed by the helically wound outer conductors 32 and 34, the dielectric material 36 and stranded center conductor 38. The non-insulated outer conductors are in continuous electrical contact along the length of the cable.

In the embodiment shown, center conductors 37 and 38 are made from 7 stands of 24 AWG tinned copper wire. Stranded wire is used to make the Siamese cable more flexible. Cellular polyethylene with a dielectric constant of 1.64 is extruded onto the inner conductors. A normal coaxial cable with this dielectric has a relative velocity of propagation of 78% that of free space. The extrusion is set to create inner dielectric 35 and 36 having an outside diameter of 0.146 inches. The dielectrics 35 and 36 in the two coaxial lines are color coded so that the two lines can easily be identified at each end of the cable. This core is surrounded by 44 helically wrapped conductors with a pitch angle of approximately 30 degrees to provide essentially 100% optical coverage of the core. Of the 44 conductors there are 42 non-insulated 30 AWG Tinned copper conductors 31 and 32 and 2 enamel insulated 30 AWG copper conductors 33 and 34. The enameled conductors 33 and 34 force the current to follow the helical nature of the outer conductors. The helical nature of the outer conductor slows the cable propagation to 73% that of free space. Outer conductors 31/33 and 32/34 are counter wound. By being counter wound, the two braids make enhanced electrical contact as the strands of wire fit together. The two leaky coaxial transmission lines are enclosed in a high-density polyethylene jacket 30. The nominal impedance of the coaxial cables is 47 ohms.

Figure 3:
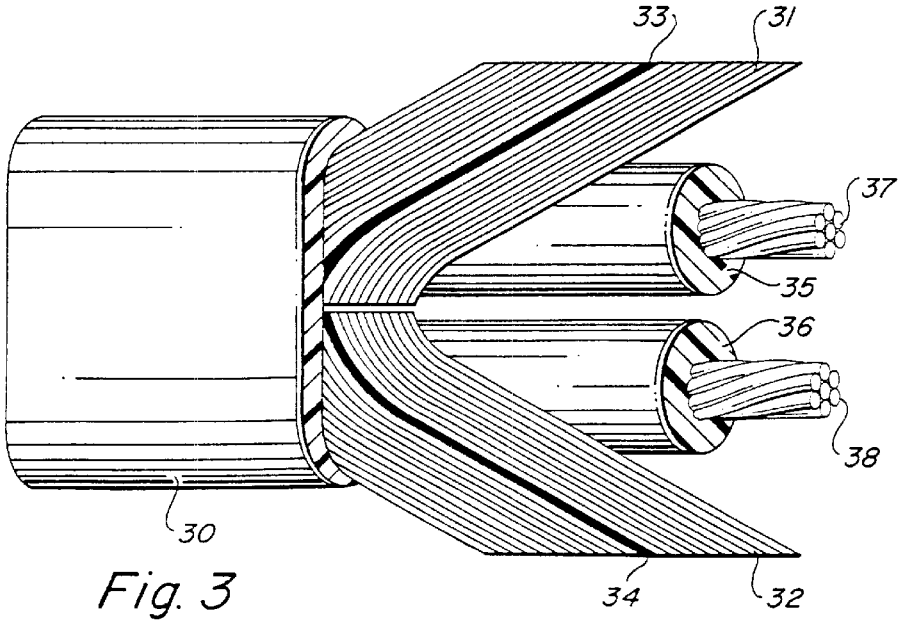
FIG. 3 is a perspective view of the Siamese leaky coaxial cable of FIG. 2 showing the pitch angle of the cable and the counter winding of the two outer conductors.

The pitch and orientation of the helically wound outer conductors 3A and 3B can be seen in FIG. 3. The pitch of the braid determines the amount of coupling to the external surface wave and the velocity of the surface wave. As a slow wave structure, the helical windings do not require the presence of a surrounding dielectric medium to support a surface wave. In the past, leaky cable sensors have been restricted to buried applications where the burial medium has a dielectric constant suitable to support a surface wave. With the helical outer conductors, the cable described herein supports a surface wave when mounted in the air or on the surface of the terrain.

The fields produced by the Siamese leaky coaxial cable are more uniform along their length because outer conductors 31 and 32 are in good electrical contact. In cables designed with separated transmit and receive cables, the outer conductors support a two-wire line mode of propagation. This mode of propagation is highly susceptible to any motion of the two cables and to changes in the dielectric between the two cables. Changes in dielectric constant of the medium surrounding the two-wire line cause multiple reflections and cancellations with the desired surface wave. Motion of the conductors can create nuisance alarms on the sensor. The multiple reflections cause the surface wave to be non-uniform. Putting outer conductors 31 and 32 in continuous electrical contact eliminates the two-wire line mode of propagation and this source of nuisance alarms and non-uniform fields is eliminated.

With the outer conductors 31 and 32 in continuous electrical contact along the length of the cable, essentially the same current flows on the outside surface of the conductors. Because the outer conductors 31/33 and 32/34 are counter wound their longitudinal magnetic fields tend to cancel while their circumferential magnetic field support each other. This is desirable since the circumferential magnetic field support the desired surface wave while the inductive fields produced by the longitudinal magnetic fields lead to unwanted radiations. Also, leaky cable systems with cable that are not in electrical contact along their length also support Two-wire line modes of propagation which can corrupt the surface wave thereby causing a non-uniform detection zone and nuisance alarms.

Most leaky coaxial cables produce both a surface wave and induction fields that are bound to the cable. Close to the cable the surface wave dominates and at further ranges the induction field dominates. The surface wave for the present Siamese cable dominates out to a radial distance of 5 feet at which point the induction field prevails. The well-controlled surface wave is primarily responsible for the detection of intruders while the induction fields are measured to determine compliance with radio regulations which are typically measured at 30 meters from the cable.

Figure 4:
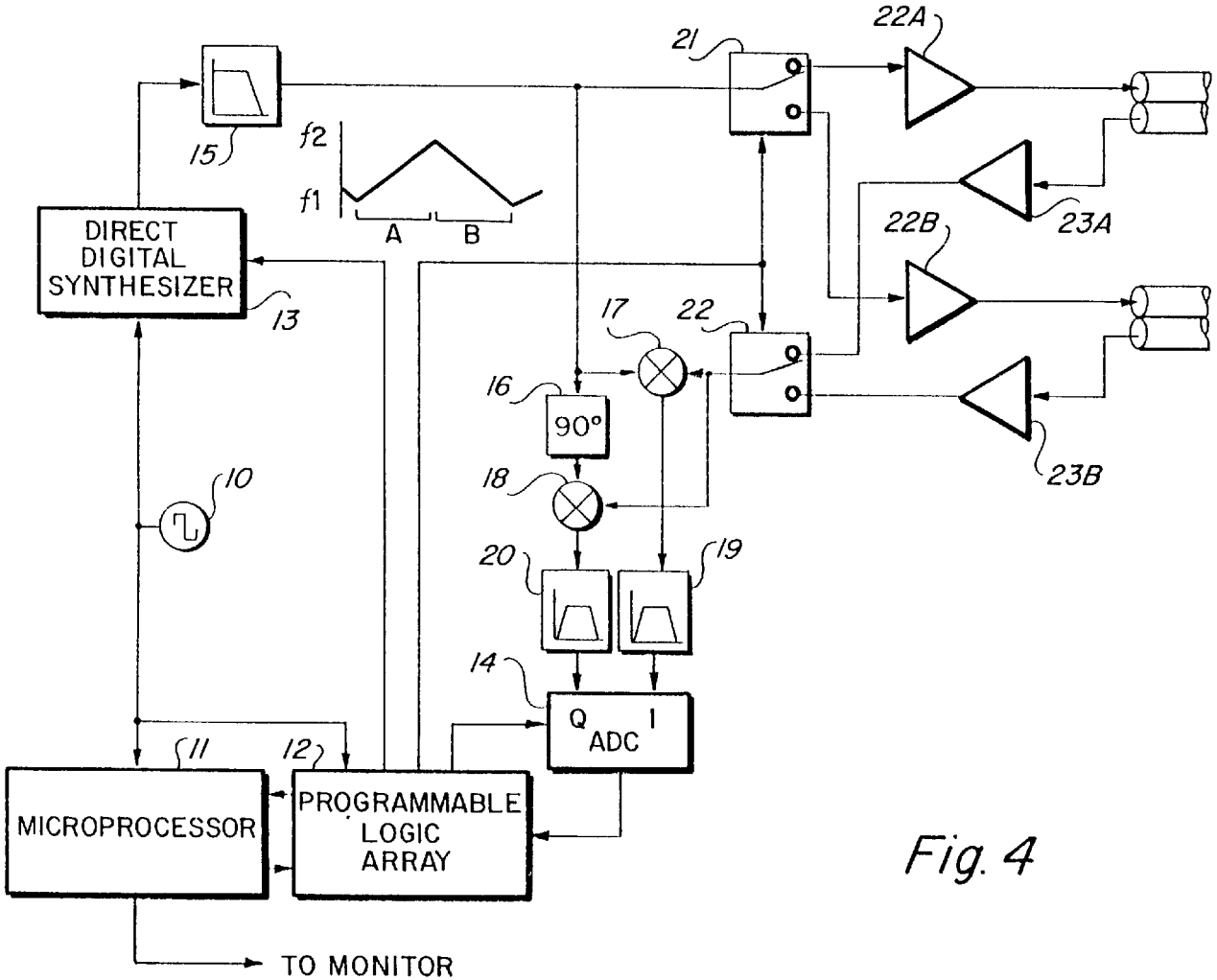
FIG. 4 is a functional block diagram of the Processor 1 of FIG. 1.

The functional block diagram of the Processor 1 is illustrated in FIG. 4. All frequencies used in this system are generated from one 102.4 MHz crystal controlled oscillator 10 so as to minimize noise caused by beat frequencies. This clock frequency is used directly in the Direct Digital Synthesis (DDS) circuit 13 and the Programmable Logic Array (PLA) circuit 12. The clock is divided by 2 and used by the microprocessor 11. The microprocessor uses the PLA circuit 12 to control the DDS circuit 13 to generate the sweep frequency and to control the Analog to Digital Converter 14 as it samples the received signal.

In the preferred embodiment of the invention, the DDS circuit 13 generates a sweep that increases linearly from f1=21.348 MHz to f2=29.822 MHz and then decreases linearly from f2 to f1. Operating in the HF band reduces the cable attenuation and creates a larger detection field.

In the text "An Introduction to Ultra-Wideband Radar" by James D. Taylor published by CRC Press in 1995 the Percentage Bandwidth is defined on page 12 as $$\%\ BW = \frac{2(f2 - f1)}{f2 + f1} \times 100$$

Using this formula definition, the FM CW cable guided radar described herein has a 33.1 Percent Bandwidth, which is considerably as a more than 20 Percent Bandwidth that is defined by Taylor and generally accepted as a minimum for an Ultra-wide Band Radar. The period for the complete sweep is 72.72 milliseconds. The upward portion of the sweep is applied to cable A and the downward portion of the sweep to cable B. A target on cable A or cable B is illuminated 50 percent of the time. There are significant cost savings in time sharing much of the signal processing hardware between cable A and B.

In the preferred embodiment of the invention as shown in FIG. 4, the microprocessor 11 is a Motorola MCF5206e, the Programmable Logic Array 12 is a Lattice Vantis model M4-192/96, the DDS circuit 13 is an Analog Devices Inc. part AD9852 and the Analog to Digital Converter is Crystal 24-bit Stereo model CS5360 converter.

The output of the DDS 13 is passed through a lowpass filter 15 to remove the harmonics that are created by the DDS. The output of lowpass filter 15 is switched between cable power amplifiers 22A and 22B in digitally controlled switch 21. Switch 21 is controlled by the PLA 12 so that power amplifier 22A receives the upward going portion of the sweep and power amplifier 22B receives the downward going portion of the sweep. Power amplifier 22A is connected to the transmit line in cable A and power amplifier 22B is connected to the transmit line in cable B. Power amplifiers 22A and 22B transmit 250 milliwatts of peak power into sensor cables 2A and 2B respectively.

The receive line in cables 2A and 2B connects the RF signals received from sensor cables 3A and 3B to the processor via amplifiers 23A and 23B which amplify the received signals. These amplifiers have a bandpass filtering characteristic designed to pass the $f1$ to $f2$ band of frequencies while filtering out-of-band frequencies. The output of amplifiers 23A and 23B connect to the digitally controlled switch 22. Switch 22 is controlled by PLA 12 so that the rest of the receiver circuitry is switched from cable A to cable B synchronously with the application of power to cables A and B.

The output of switch 22 is passed to mixers 17 and 18. The local oscillator 10 (LO) input to mixer 17 is derived from the complete sweep output of the DDS 13 through filter 15. The LO signal for mixer 18 is the same as that for mixer 17 but displaced by 90 degrees in phase shift circuit 16. In this way mixers 17 and 18 provide quadrature detection of the received signals. The output of mixer 17 is passed through bandpass filter 19 to generate an in-phase response "I" while the output of mixer 18 is passed through bandpass filter 20 to generate the quadrature response "Q".

Bandpass filters 19 and 20 have 3 dB corner frequencies of 40 and 600 Hz. The time delay associated with propagation of the transmitted signal to the target and back to the receiver generates an IF frequency that is proportional to the distance to the target. The bandpass filters pass the target response while filtering out unwanted signals. The lowpass corner frequency of 600 Hz is designed to remove the upper cross products arising from the mixers as well as interference signals received on the cables. The highpass corner frequency of 40 Hz is designed to remove responses from objects moving near the lead-in cable. With a sweep period of 72.72 milliseconds and a 73% velocity cable, a target at the start of the detection zone creates an IF response at 45 Hz. A target at the end of the 200-meter zone creates a frequency of 503 Hz. Targets at intermediate locations create a proportional frequency.

The amplitude of a target response varies with distance along the cable due to attenuation in the cable and the build up of the field along the length of the cable. The attenuation in the cable is primarily due to copper losses. Hence the attenuation increases slightly as the sweep increases from f1=21.348 MHz to f2=29.822 MHz. At 25 MHz the measured two-way attenuation in a 215 meter length of Siamese cable is 27 dB. While the field reaches an acceptable level for detection at the end of the 15 meters of lead-in and start up cable, it continues to increase with distance along the cable. In the first 50 to 75 meters of cable the field actually builds faster than it is attenuated due to copper losses. The end result is that there is approximately 20 dB variation in response amplitude from its peak between 50 to 75 meters and at 200 meters. Prior art systems require "graded" cable to accommodate the effects of attenuation. In a graded cable, the apertures in the leaky cable are increased in size along the length of the cable to compensate for cable attenuation. In the case of the present invention, the ability to locate the intruder along the length of the cable enables the system to use a separate threshold for every 2 meter interval along the length of the cable. This feature accommodates the 20 dB variation from the peak at 50 to 75 meters to the null at the end of the cable as well as local variations in sensitivity.

The outputs of the passband filters 19 and 20 are digitized at fixed intervals during the sweep to create 1024 samples of the in-phase and quadrature phase components for cable A (QA, IA) and another 1024 samples for cable B (QB, IB). It is important to the operation of the system that the sampling by the ADC 14 be synchronous with the frequency sweep to minimize frequency jitter noise in the sampled data. Therefore, the generation of the sweep frequency modulation and the sampling are controlled by the one crystal controlled clock 10.

With no targets present there will be a response from both cables. Leaky cable sensors have clutter which comes from backwards coupling between the transmit and receive lines, imperfections in the cables, irregularities in the medium surrounding the cable and reflection from the termination. The termination reflections are due to miss matched loads on the coaxial lines and the termination of the surface wave. In practice, the reflections from the termination is usually larger than all other sources of clutter. This results in the In-phase and Quadrature-phase clutter having a dominant sine and cosine shape. The number of cycles in these waves depends on the length of the cable expressed in wavelengths at the difference frequency f2−f1.

Figure 5:
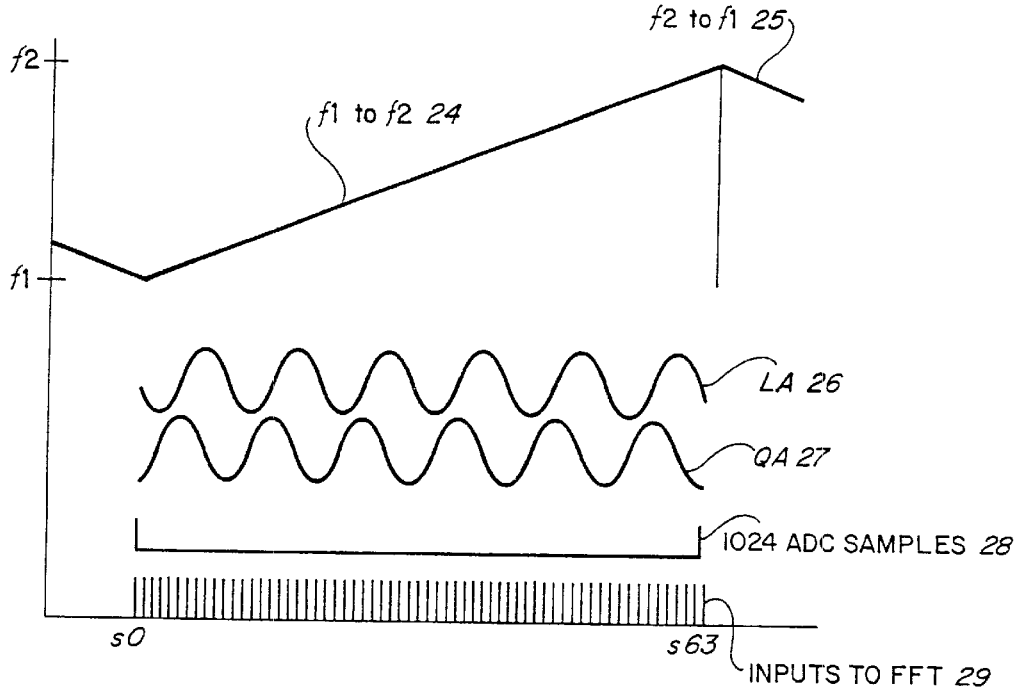
FIG. 5 is a series of waveforms showing the sinusoidal nature of the baseband signals due to a single point reflection and the relationship between the sampling of the baseband signals and the frequency sweep.

In practice, the installer cuts the 215-meter long cable to fit the site. The clutter response shown by the waveforms in FIG. 5 illustrates a system where all the clutter comes from the end of a 70-meter long cable. As shown, the In-phase response IA 26 is ninety degrees out of phase with the Quadrature-phase response QA 27.

The DDS frequency sweeps from f1=21.348 MHz to f2=29.822 MHz in 1024 small steps. Each step is 8.89 kHz and lasts for 35.51 microseconds. The 1024 steps take 36.36 milliseconds to sweep upwards from f1 to f2 and another 36.36 milliseconds to sweep downwards from f2 to f1 for a total period of 72.72 milliseconds. This corresponds to a sweep frequency of 13.75 Hz. During each 35.51 microsecond step, the Analog to Digital Converter 14 simultaneously samples the In-phase and Quadrature-phase response.

As shown in FIG. 5, when the clutter comes from one location it will appear sinusoidal. If there are no targets present, the clutter response remains stationary since each digital sample is the same from sweep to sweep. While noise may corrupt these measurements, the mean value of the sweep to sweep samples remains essentially constant. Each of the 1024 samples appears as a Continuous Wave (CW) leaky cable sensor with quadrature detection and an sample rate of 13.75 Hz. These 1024 CW sensors operate simultaneously at every 8.89 kHz from f1=21.348 MHz to f2=29.822 MHz. The unique amplitude and phase associated with each of the 1024 points trace out the sinusoidal IA and QA responses shown in FIG. 5.

The number of data points used in the subsequent digital signal processing (DPS) can be reduced by adding groups of 16 consecutive In-phase and Quadrature-phase samples. This summing generates 64 point In-phase and 64 Quadrature-phase samples for the cable A upward sweep and 64 point In-phase and 64 Quadrature-phase samples for the cable B downward sweep. For a cable of 215 meters, there would be 16.4 cycles in the IA and QA response as opposed to the 5.8 cycles shown in FIG. 5. The 64 sample points are adequate to meet the Nyquist sampling criteria for reproducing clutter coming from the end of the cable.

For a typical installation of the Siamese cable sensor, the clutter is 40 to 50 dB less than the transmitted signal. A human intruder moving in proximity to the sensor cable has a response, which is 90 to 110 dB below the transmitted signal. This means that Target to Clutter ratios of from 40 to 70 dB can be anticipated. The 18-bit or 105 dB resolution of the ADC 14 is adequate to measure the Target in the presence of the Clutter. 32-bit resolution is used within microprocessor 11 to accommodate this large Target to Clutter dynamic range.

Clutter is not entirely constant and it changes slowly in time due to environmental changes, such as changes in the moisture content in the medium surrounding the cable. These changes are relatively slow compared to the response to an intruder. The first step in the DSP is to perform a highpass filter function on each of the 64 IA, QA, IB and QB samples to remove the clutter. A passband of 0.02 to 5 Hz is adequate to remove the Clutter while preserving the intruder response. Once the Clutter is removed the dynamic range requirements on the DSP are significantly reduced. A range of up to 60 dB can be anticipated when one considers the attenuation of the cable, variation in target cross section and the size of the detection zone. This means that the balance of the DSP can be performed with 16-bit resolution in microprocessor 11.

While the sinusoidal responses 26 and 27 in FIG. 5 have been used to describe the clutter, they can also be used to illustrate the incremental response to an intruder at a range of 70 meters. The incremental response is that after the clutter is removed and is smaller in amplitude than the clutter, but it will have the same sinusoidal nature. The frequency of this response is a measure of the location of the intruder along the length of the cable.

A Fast Fourier Transform (FFT) is used by microprocessor 11 to convert the target response information into target location information. In order to make optimal use of the computational burden imposed on the microprocessor by the FFT, it is desirable to select $2^N$ points. A 64 point complex FFT, is used. The In-phase and Quadrature-phase samples of the incremental responses form the real and imaginary parts of the 64 complex inputs to the FFT.

In order to gain maximum resolution from the FFT a form of digital Automatic Gain Control (AGC) is performed around the FFT. The 64 In-phase and Quadrature-phase samples are scaled so that the most significant bit just fits within a 16-bit word. The FFT computation is performed and then the inverse scaling is performed with the result once again stored in a 32-bit word. The end result is that the target amplitude information is preserved while optimal use is made of the FFT.

While from a target response point of view one could have used the DDS 13 to make 64 steps as opposed to 1024 steps in going from f1 to f2 and achieved a similar result, the use of 1024 steps and averaging provides much better immunity to interfering signals.

Of the 64 complex numbers that are computed by the FFT, the first 19 correspond to targets along the 215 meter length of cable. The first 2 of the 19 outputs correspond to targets on the lead-in cable. This leaves approximately 17 range bins to represent the 200 meters of sensor cable. The FFT operation is performed on the cable A data and then repeated on the cable B data to produce target amplitude and location data that is updated at a 13.75 Hz rate.

The 17 complex FFT outputs contain both amplitude and phase information pertaining to targets along the length of sensor cable. The square root of the sum of the squares of the real and imaginary parts of each bin output is a measure of the amplitude of the response. The arctangent of the imaginary component divided by the real component is related to the phase angle of the target response of a CW sensor operating at the mean of f1 and f2. This phase information can be used in refining the location of the target.

The response of the present invention to multiple simultaneous targets is that if the targets are sufficiently far apart along the length of the cable, the FFT will in fact locate each of the multiple targets. If there are two simultaneous targets that are relatively close to each other, it is difficult to determine that there are two separate targets. Resolution is largely dependent upon the bandwidth of the sensor. In the FM CW cable guided radar described herein, the bandwidth is the difference between frequency $f1$ and $f2$. The wider the bandwidth, the better the resolution.

Target resolution is not a significant factor in outdoor perimeter security. While it is theoretically possible to have two people cross through the detection zone at precisely the same time, this is virtually impossible to do in practice. Without a lot of experimentation the intruder does not know the exact location of the invisible detection zone. In addition the exact magnitude of the response to a person is a very complex function of the persons anatomy and movement. As a result of these factors, the worst situation is that the two intruders get detected as a single target at a location somewhere between the two. From a security point of view this is quite acceptable.

When first installed, a person walks along the length of the cable to calibrate the sensor. The processor locates the person and the amplitude is recorded as a function of the location. These data are stored in nonvolatile memory in the processor. When a target response is received it is located and then compared to a threshold, which is proportional to the sensitivity data stored during calibration. In this way, the sensor sensitivity is leveled along the length of the cable.

It is the ability of the present FM CW cable guided radar system to first locate the intruder that it makes it possible to avoid "graded" cable. The calibrated threshold levels at the different intervals establish the sensitivity along the length of the leaky cable. The design features of the cable structure shown in FIGS. 2 and 3 provide a relatively low cost cable for intrusion detection in comparison to those systems requiring "grading."

The FFT algorithm assumes that the samples represent an integer number of cycles of a periodic function. In the example shown in FIG. 5, it is apparent that there are step changes in the In-phase and Quadrature-phase responses at the start on each new sweep. This means that the energy will appear in more than one frequency bin but the largest response will be in the frequency bin that is closest to the target. When the target range is such that the two baseband responses start and end at the same point all of the energy will appear in the single frequency bin associated with that location. Ratios of the two largest frequency bin, responses can be used to locate the target between frequency bin locations.

The Motorola MCF5206e microprocessor 11 operating at 51.17 MHz is able to easily compute the 64 point complex FFT for both cables at the 13.75 Hz rate for both cables A and B. At the output of the FFT frequency, bins 0 and 1 correspond to locations inside the lead-in cable and can be ignored. Frequency bins 2 through 17 correspond to the active cable and the remaining bins are beyond the end of the cable. Each frequency bin corresponds to 12.93 meters of cable. By interpolating between range bins, location accuracy of within 1 to 2 meters can be obtained. This has been found adequate to track the normal sensitivity variations along the length of the cable.

At the completion of each FFT, the microprocessor scans the outputs in frequency bins 2 to 17 to find local peaks. The local peak data is then integrated over a ½ second period to further increase the Signal to Noise ratio. The integrated amplitude data is used to detect if one or more targets is present.

When a target is declared, the signal from the microprocessor can be used to turn on a relay or a message can be sent on an RS232, RS422 or RS485 line to a central monitoring panel.

In multiple processor systems, cable A from one processor can be connected to the cable B from the adjacent processor. In this case, a link unit connecting the two cables replaces the lead-out cables 5A and 5B. The cables from the adjacent processor modules terminate the surface waves. The fact that sweep on cable A is upward from frequency $f1$ to $f2$ while the frequency on cable B sweeps downward from $f2$ to $f1$ minimizes the interference between adjacent processors. The link unit provides RF terminations to the two cables and passes power and data from one cable to the next so as to create a power and data network around the perimeter. In that type of installation, DC power is superimposed on the receive cable 38 and a Frequency Shift Keying (FSK) data signal is superimposed on the transmit cable 37.

The frequency dependent baseband response of the present invention can be used to provide analog compensation for cable attenuation. While this method is not implemented in the present invention, the frequency response of the bandpass filters 19 and 20 can be designed to compensate for the effects of cable attenuation. This could be used to reduce the dynamic range requirements of the Digital Signal Processing.

While the ability of above-described FM CW detection system to locate the intruder enables one to use the lower cost Siamese cable described herein, it can also be used with other leaky coaxial cables as well. Similarly, the relatively complex and expensive pulse radar techniques described in U.S. Pat. No. 4,091,367 could be modified to operate with the Siamese cable described in this patent. However, the advantages of the present invention including cost-effective performance are achieved using the FM CW signal processing with the Siamese cable as described in connection with the preferred embodiment of this patent.

A person understanding this invention may now conceive of alternative embodiments and variations in the invention while using the teachings set forth herein. All are considered to be within the sphere and scope of this invention as defined in the claims appended hereto.

What is claimed is:

1. A method for the detection and location of an intruder crossing a boundary, said method comprising the steps of:

a) locating a transmit-receive pair of leaky transmission lines along the boundary;

b) applying a CW signal having sweep frequency modulation to the transmit line;

c) calibrating and storing intruder amplitude levels for multiple locations along the boundary;

d) recovering signals from the receive line;

e) Sampling the recovered signals in synchronism with the sweep frequency modulation to generate data signals;

f) filtering the data signals to remove clutter signals;

g) transforming the data signals to produce intruder location and amplitude data; and h) determining intruder location and then comparing an intruder amplitude level with the amplitude data whereby the location and presence of an intruder is confirmed.

2. The method in accordance with claim 1 wherein the step of applying a CW signal includes having linear sweep frequency modulation.

3. The method in accordance with claim 2 wherein the step of recovering signals from the receive line includes generating inphase and quadrature signals therefrom.

4. The method in accordance with claim 3 wherein the CW signal has a duty cycle of at least twenty five percent.

5. The method in accordance with claim 4 wherein the step of transforming the sampled data signals includes using a Fast Fourier Transform to convert the sampled data signals into intruder location data.

6. In an intrusion detection system of the type employing a pair of leaky transmit and receive transmission lines for the coupling of electromagnetic energy along the length thereof, a cable assembly comprising:

a) first and second coaxial lines, each coaxial line having a center conductor surrounded by a dielectric and helically wrapped with a multi-strand outer conductor;

said multi-strand outer conductor completely covering the dielectric;

b) at least one insulated strand contained in the multi-strand outer conductor of each line; and c) a dielectric jacket encompassing the first and second coaxial lines and maintaining contact between the multi-strand outer conductors thereof, said insulating jacket supporting a surface wave upon the application of a signal to one of the coaxial lines.

7. The cable assembly of claim 6 wherein the multi-strand outer conductors of said coaxial lines are counter wound in opposing directions.

8. The cable assembly of claim 7 wherein the pitch angle of the helically wrapped outer conductors has a pitch angle of approximately thirty degrees.

9. The cable assembly of claim 8 wherein the outer conductor of each coaxial line fully surrounds the dielectric.

10. The cable assembly of claim 9 wherein the counter wound helically wrapped outer conductors are adjacently fitted along the length thereof.

11. The cable assembly of claim 10 wherein the center conductor is multi-strand.

12. A system for the detection and location of an intruder crossing a boundary, said system comprising:

a) transmit and receive transmission lines positioned along a boundary, said lines being adjacently spaced for the coupling of electromagnetic signals therebetween;

b) a frequency modulated signal generator connected to the transmit line, the signal generator supplying a sweep frequency signal thereto;

c) a detector connected to the receive line for sampling the coupled electromagnetic signal therein and providing a digital response signal, and d) a microprocessor connected to the detector circuit and programmed to determine the frequency of the digital response signal, the location of an intruder being a function of the frequency of the response signal, then, second, to apply a location specific threshold to the response signal.

13. The system of claim 12 wherein said transmit and receive transmission lines further include coaxial cables having helically wound multi-strand outer conductors, said outer conductors being maintained in contact.

14. The system of claim 13 wherein said transmit and receive transmission lines are leaky coaxial cables, each of said coaxial cables having a multi-strand outer conductor with at least one of the multi-strands being insulated from adjacent multi-strands.

15. The system of claim 14 wherein said transmit and receive transmission lines further include a dielectric jacket encompassing the leaky coaxial cables and maintaining contact between the multi-strand outer conductors thereof.

16. The system of claim 15 wherein the outer conductors are counterwound in opposing directions.

17. The system in accordance with claim 12 wherein said transmit and receive transmission lines are leaky coaxial cables each cable having a helically wound outer conductor, and said signal generator provides a CW signal to the transmit line having a duty cycle of at least twenty five percent.

18. The system in accordance with claim 17 further comprising first and second pairs of transmit and receive transmission lines, said signal generator providing a CW signal to the transmit line of each pair having a duty cycle of at least twenty five percent.

19. The system in accordance with claim 18 wherein said signal generator generates linear sweep frequency modulation having upward and downward sweeps said modulation having alternating fifty percent duty cycles on each of said first and second pairs.

20. The system in accordance with claim 19 wherein said detector connected to the receive line samples the coupled signal therein in synchronism with the sweep frequency.

21. The system in accordance with claim 20 further comprising a filter connected to the detector for the removal of clutter signals from the digital data signal.

22. The system in accordance with claim 21 wherein said microprocessor uses a Fast Fourier Transform to convert the digital response signal into intruder location data.

* * * * *